US008240671B2

(12) United States Patent
Chang

(10) Patent No.: US 8,240,671 B2
(45) Date of Patent: Aug. 14, 2012

(54) ROPING PRACTICE APPARATUS

(75) Inventor: Hsi-Chang Chang, Taichung (TW)

(73) Assignee: Eastwest International (Taiwan) Enterprises, Taichung (TW)

( * ) Notice: Subject to any disclaimer, the term of this patent is extended or adjusted under 35 U.S.C. 154(b) by 236 days.

(21) Appl. No.: 12/723,856

(22) Filed: Mar. 15, 2010

(65) Prior Publication Data

US 2011/0221135 A1 Sep. 15, 2011

(51) Int. Cl.
*A63B 69/00* (2006.01)
*A01K 15/02* (2006.01)

(52) U.S. Cl. ..... 273/368; 273/367; 119/839; 446/338; 446/384

(58) Field of Classification Search ..... 273/359, 273/366–370, 406, 407, 336–339; 119/839; 40/538, 540; 446/330, 338, 384
See application file for complete search history.

(56) References Cited

U.S. PATENT DOCUMENTS

| | | | | | |
|---|---|---|---|---|---|
| 2,572,146 | A | * | 10/1951 | Henry | 273/370 |
| 2,726,870 | A | * | 12/1955 | Auger | 273/370 |
| 3,160,983 | A | * | 12/1964 | Smith et al. | 446/270 |
| 3,230,666 | A | * | 1/1966 | Gardel et al. | 446/338 |
| 3,287,848 | A | * | 11/1966 | Katz et al. | 446/344 |
| 3,303,821 | A | * | 2/1967 | Lee | 119/839 |
| 3,959,919 | A | * | 6/1976 | Baulard-Cogan | 446/305 |
| 4,286,788 | A | * | 9/1981 | Simington et al. | 273/359 |
| 4,451,045 | A | * | 5/1984 | Fesmire | 273/338 |
| 4,662,642 | A | * | 5/1987 | Archibald et al. | 273/339 |
| 4,662,857 | A | * | 5/1987 | Quinn et al. | 446/371 |
| 4,804,192 | A | * | 2/1989 | Matsumoto et al. | 273/336 |
| 4,867,730 | A | * | 9/1989 | Lee | 446/353 |
| 4,874,179 | A | * | 10/1989 | Henderson | 273/338 |
| 4,913,676 | A | * | 4/1990 | Koguchi et al. | 446/300 |
| 4,988,099 | A | * | 1/1991 | Kuna et al. | 273/445 |
| 4,995,618 | A | * | 2/1991 | Panzner | 273/367 |
| 5,080,373 | A | * | 1/1992 | Jones | 273/338 |
| 5,286,032 | A | * | 2/1994 | Spencer | 273/339 |
| 5,568,926 | A | * | 10/1996 | Kaptein | 273/359 |
| 6,168,160 | B1 | * | 1/2001 | DeOreo et al. | 273/374 |
| 6,394,282 | B1 | * | 5/2002 | Pan | 211/1.51 |
| 6,413,594 | B1 | * | 7/2002 | Onishi | 428/7 |
| 6,431,941 | B1 | * | 8/2002 | Frawley et al. | 446/330 |
| 6,478,164 | B1 | * | 11/2002 | Pan | 211/1.51 |
| 6,565,407 | B1 | * | 5/2003 | Woolington et al. | 446/175 |
| 6,695,673 | B1 | * | 2/2004 | Stadbauer | 446/305 |
| 6,736,399 | B1 | * | 5/2004 | Copenhaver | 273/339 |
| 7,293,775 | B1 | * | 11/2007 | Donnelly et al. | 273/359 |
| 7,430,990 | B1 | * | 10/2008 | Copenhaver | 119/839 |
| 2004/0132378 | A1 | * | 7/2004 | Su | 446/330 |
| 2005/0282128 | A1 | * | 12/2005 | Brinkerhoff et al. | 434/247 |
| 2008/0150235 | A1 | * | 6/2008 | Bliehall | 273/359 |
| 2009/0098794 | A1 | * | 4/2009 | Wang et al. | 446/297 |
| 2009/0104842 | A1 | * | 4/2009 | Gu | 446/330 |
| 2009/0189352 | A1 | * | 7/2009 | Kemp | 273/359 |

* cited by examiner

*Primary Examiner* — Mark Graham
(74) *Attorney, Agent, or Firm* — Rosenberg, Klein & Lee

(57) ABSTRACT

A roping practice apparatus for realistically simulating motion of the head of an animal to train a roper in roping skill. The roping practice apparatus includes: a steering unit drivable and rotatable by a power source; a transmission section rotatable in response to the rotation of the steering unit, the transmission section having a first end mounted on the steering unit and a second end; a universal actuator to which the second end of the transmission section is pivotally connected; and a driven section mounted on the universal actuator and rotatable in response to the rotation of the transmission section. A head model is connected with the driven section and drivable by the driven section to swing back and forth and left and right within a range of 360°.

43 Claims, 7 Drawing Sheets

ROPING PRACTICE APPARATUS

BACKGROUND OF THE INVENTION

1. Field of the Invention

The present invention relates generally to a roping practice apparatus, and more particularly to a roping practice apparatus for simulating motion of the head of an animal to train a roper.

2. Description of the Related Art

Various conventional roping practice apparatuses have been disclosed for simulating the movements of an animal such as a calf to train a roper in roping skill. For example, U.S. Pat. No. 6,945,534 B1 entitled "mechanical roping practice device", U.S. Pat. No. 4,995,618 entitled "movable roping exercise target" and U.S. Pat. No. 6,736,399 B1 entitled "mechanical roping steer apparatus with enhanced stride simulation" disclose several kinds of roping practice apparatuses for training ropers. A conventional roping practice apparatus generally has a wheeled calf model. The calf model can be pulled and moved through a linkage or a cord to train a roper in roping a moving target.

In order to more realistically simulate the movements of the head of an animal for a roper to exercise more difficult roping skill, the head models of some conventional roping practice apparatuses are movable. For example, U.S. Pat. No. 7,293,775 B1 entitled "roping practice apparatus" discloses a calf model having a mechanical head section. The head section is provided with a frame body and pivot shafts, whereby the head section can swing left and right. In U.S. Patent No. 2004/0101811 A1 entitled "mechanical dally coach" and U.S. Pat. No. 7,430,990 B1 entitled "mechanical roping steer apparatus with pivoting horns and pivoting horn support", a head section of an animal model is equipped with a linkage mechanism, whereby the head section can swing up and down. In addition, movable horns are pivotally connected to the head section by pivots. When a roper ropes the horns and tensions/contracts the loop of rope, the horns will be biased about the pivots.

In U.S. Pat. No. 3,776,553 entitled "animated mechanical steer having spring biased head" and U.S. Pat. No. 4,286,788 entitled "mechanical roping steer", a complicated linkage mechanism is used to drive a head model to swing back and forth or up and down.

However, the above conventional roping practice apparatuses have some defects in structural design. For example, in U.S. Pat. No. 7,293,775 B1, the head section of the animal model can simply swing from the middle to the left side. In U.S. Patent No. 2004/0101811 A1 and U.S. Pat. No. 7,430,990 B1, the head model is driven by the linkage mechanism to simply swing up and down. Therefore, it is tried by the applicant to provide an improved roping practice apparatus, in which the head model can move within a larger range without limitation to any specific direction so as to more realistically simulate the movements of the head of a live animal. The improved roping practice apparatus has the following advantages:

1. The head model can swing left and right and up and down (or back and forth) within a range of up to 360°. Therefore, the head model can move in such a manner as to more realistically simulate the movements of the head of a live animal.
2. In contrast to the conventional roping practice apparatus that simply adopts the linkage mechanism to drive and swing the head model in a specific direction, the head model of the improved roping practice apparatus can swing without limitation to any specific direction.

3. The improved roping practice apparatus has simplified structure and is easy to assemble/disassemble. Therefore, the manufacturing cost for the roping practice apparatus is lowered.

SUMMARY OF THE INVENTION

It is therefore a primary object of the present invention to provide a roping practice apparatus for realistically simulating motion of the head of an animal to train a roper in roping skill. The roping practice apparatus includes: a steering unit drivable and rotatable by a power source; a transmission section rotatable in response to the rotation of the steering unit, the transmission section having a first end mounted on the steering unit and a second end; a universal actuator (or universal joint) to which the second end of the transmission section is pivotally connected; and a driven section mounted on the universal actuator and rotatable in response to the rotation of the transmission section. A head model is connected with the driven section and drivable by the driven section to swing within a range of 360°.

To achieve the above and other objects, the universal actuator of the roping practice apparatus of the present invention includes an outer ring, an inner ring and a connector positioned in the inner ring. Two pins are disposed on the outer ring in positions opposite to each other and radially directed to a center of the outer ring. The inner ring is formed with two shaft sockets in positions opposite to each other corresponding to the pins of the outer ring. The pins of the outer ring are pivotally connected to the shaft sockets, whereby the inner ring is swingably shaft-supported in the outer ring. Two pins are disposed on the inner ring in positions opposite to each other and radially directed to a center of the inner ring. The positions of the pins disposed on the inner ring are about 90° angularly spaced from the shaft sockets respectively. The connector is shaft-supported in the inner ring by the pins thereof, whereby the connector can be swung about the pins of the inner ring. The connector swings in a direction other than a swinging direction of the inner ring, whereby the universal actuator can move within a range of 360°.

In the above roping practice apparatus, the transmission section and the driven section are flexible or elastic shaft-like structures. The transmission section and the driven section are elastically flexible and movable in response to the rotation of the steering unit within a certain range.

The present invention can be best understood through the following description and accompanying drawings, wherein:

DETAILED DESCRIPTION OF THE PREFERRED EMBODIMENTS

Figure 1:
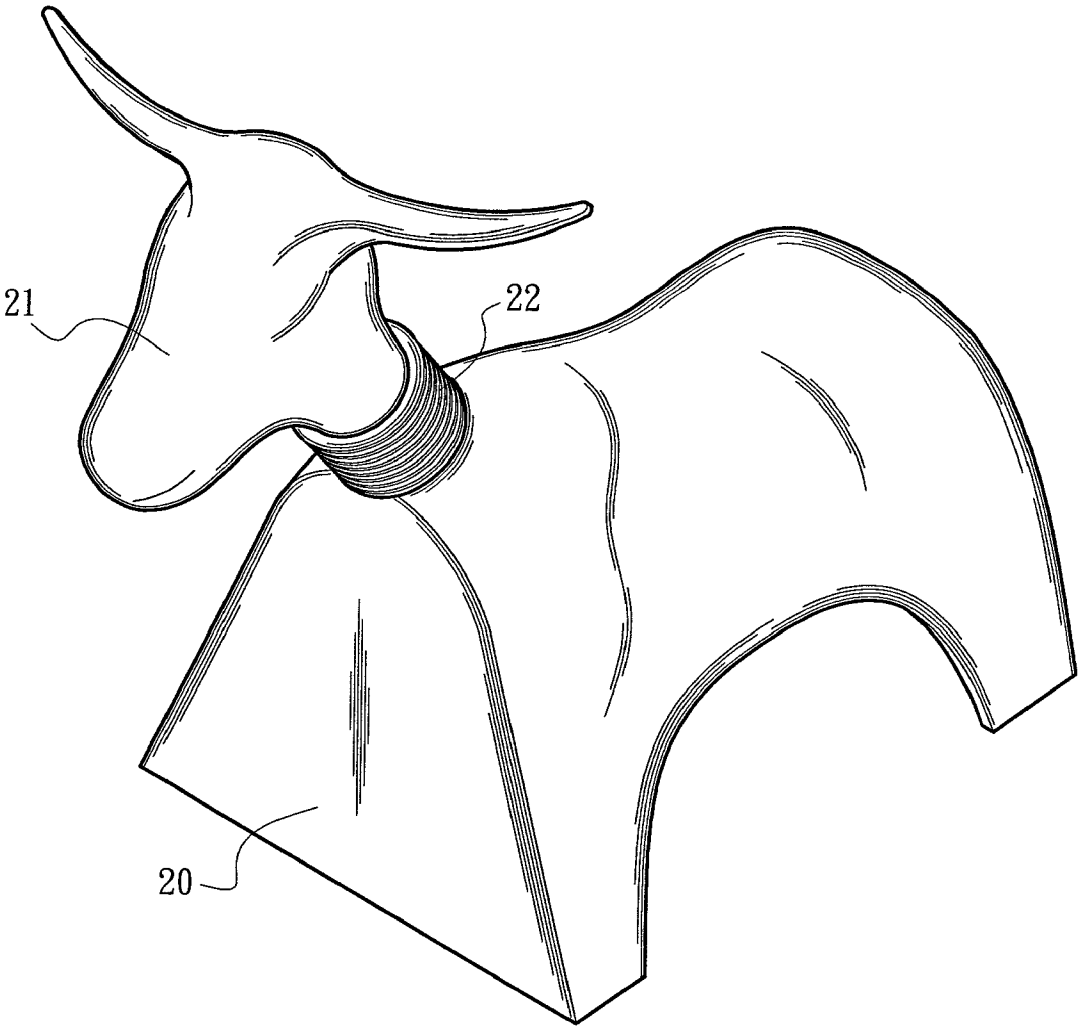
FIG. 1 is a perspective view of the roping practice apparatus of the present invention.
Figure 2:
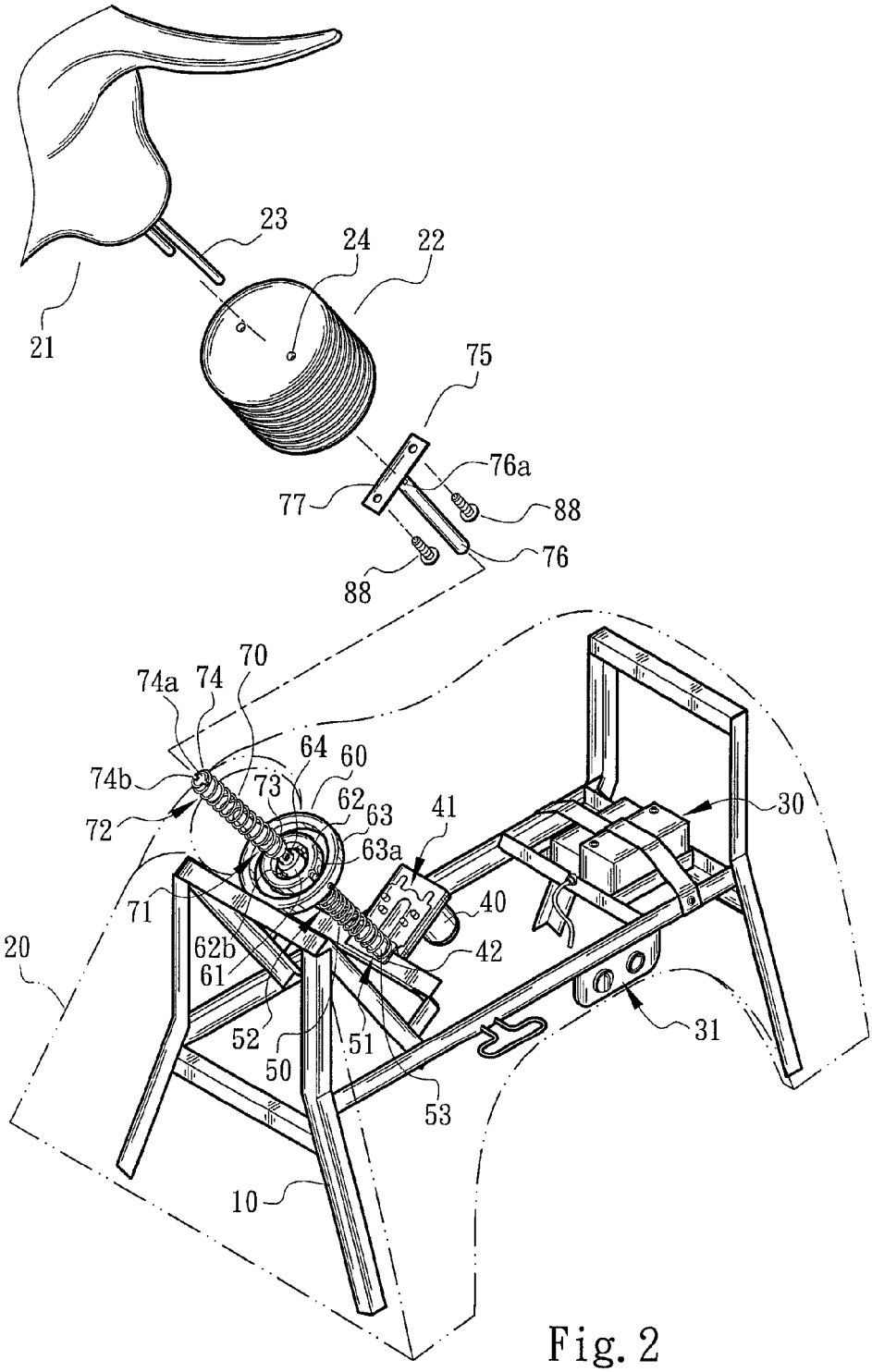
FIG. 2 is a perspective partially exploded view showing the positional relationship between the head model, the neck section, the bracket and the driven section of the present invention.
Figure 3:
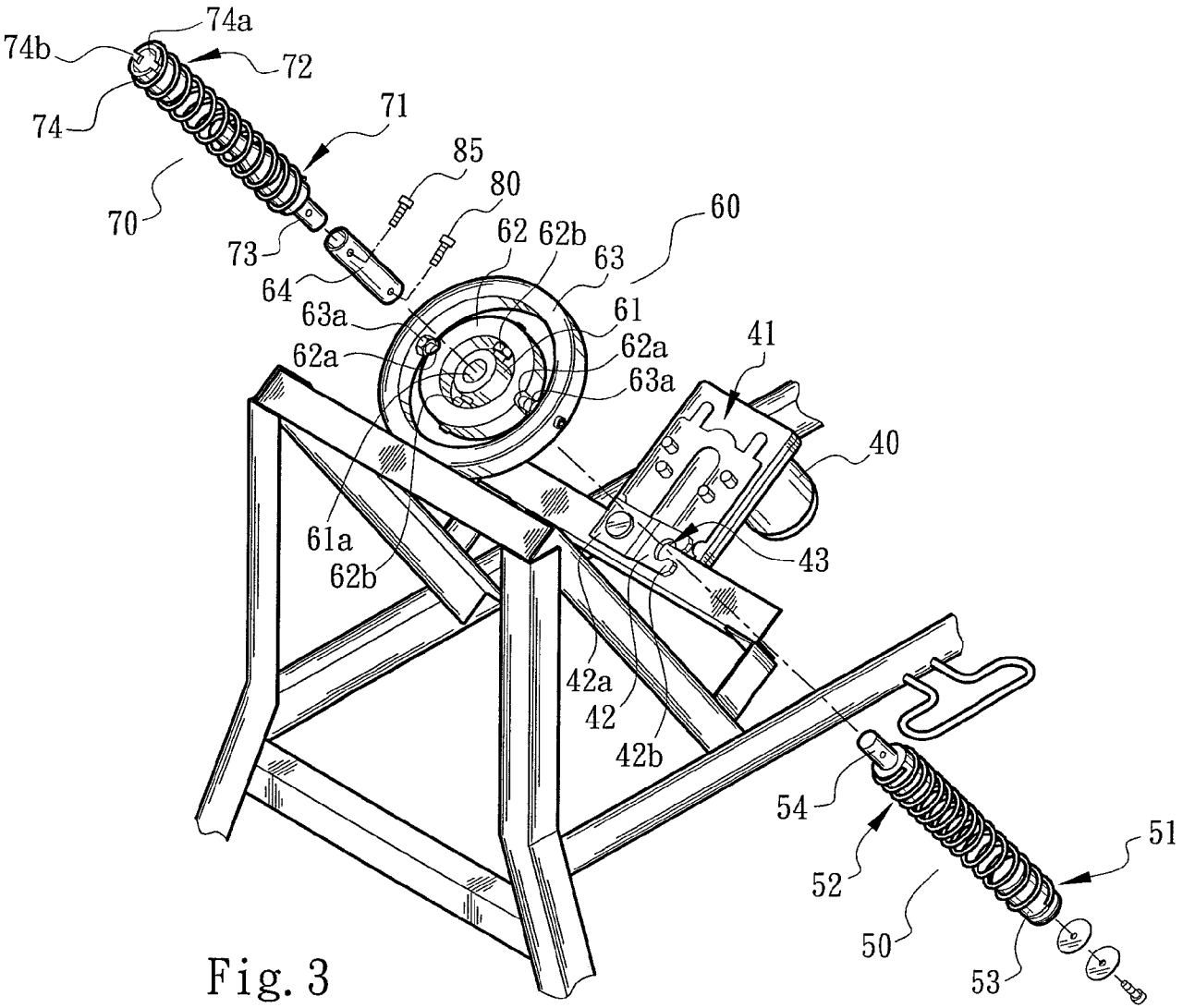
FIG. 3 is a perspective partially exploded view showing the positional relationship between the transmission section, the universal actuator and the driven section of the present invention.

Please refer to FIGS. 1, 2 and 3. The roping practice apparatus of the present invention includes a base body 10 for supporting an animal model 20 mounted thereon. In a preferred embodiment, the base body 10 is provided with a power system 30 and a controller 31. The power system 30 can be a battery or any other suitable power unit. The power system 30 serves to drive a motor 40 arranged on the base body 10 to rotate. The controller 31 serves to adjustably control the motor 40 to rotate forward or backward at different rotational speeds. The motor 40 is assembled with a transmission mechanism or a gear case 41 for driving and rotating a steering unit 42 arranged on the transmission mechanism or the gear case 41. A transmission section 50 is coupled with the steering unit 42 and rotatable in response to the rotation of the steering unit 42. The transmission section 50 is also connected to a universal actuator 60 with a connector 61 for driving a driven section 70 to rotate. A head model 21 is mounted on the driven section 70. Accordingly, when the driven section 70 is rotated, the head model 21 is synchronously driven to rotate at an adjusted rotational speed.

As shown in FIGS. 2 and 3, the steering unit 42 has the form of a cantilever or a plate structure. The steering unit 42 has a fixed end 42*a* connected with the transmission mechanism or the gear case 41 and a free end 42*b*. The free end 42*b* of the steering unit 42 is formed with an opening 43 for pivotally connecting the steering unit 42 with the transmission section 50. In a modified embodiment, the steering unit 42 is alternatively in the form of a disc-shaped structure and eccentrically pivotally connected with the transmission section 50.

Please now refer to FIG. 3. The transmission section 50 is a flexible or elastic shaft-like structure, which can be elastically bent and rotated within a certain range. In the preferred embodiment, the transmission section 50 is substantially in the form of a coil spring, including a first end 51 connected to the opening 43 and a second end 52 pivotally connected with the universal actuator 60. To speak more specifically, the first end 51 is provided with an accessory 53 locked to the opening 43. The second end 52 is provided with a shaft member 54 extending into the connector 61 of the universal actuator 60 as shown in FIG. 4.

Referring again to FIG. 3, the universal actuator 60 can be in the form of a universal joint. In the preferred embodiment, the universal actuator 60 is a ring-like structure, including an outer ring 3 fixed on the base body 10, an inner ring 62 and the connector 61 positioned on the inner ring 62. Two pins 63*a* are disposed on the outer ring 63 in positions opposite to each other. The pins 63*a* are radially directed to a center of the outer ring 63. The inner ring 62 is formed with two cavities or shaft sockets 62*a* in positions opposite to each other corresponding to the pins 63*a*. The pins 63*a* of the outer ring 63 are pivotally connected to the shaft sockets 62*a*, whereby the inner ring 62 is shaft-supported in the outer ring 63. Accordingly, the inner ring 62 can be swung about the pins 63*a* in a direction defined as back-and-forth or up-and-down swinging direction.

FIG. 3 also shows that two pins 62*b* are disposed on the inner ring 62 in positions opposite to each other and about 90° angularly spaced from the shaft sockets 62*a* respectively. The pins 62*b* are radially directed to a center of the inner ring 62 for shaft-supporting the connector 61 in the inner ring 62. Accordingly, the connector 61 can be swung about the pins 62*b* in a direction defined as left-and-right swinging direction. Therefore, the connector 61 can be swung in the left-and-right swinging direction other than the back-and-forth or up-and-down swinging direction of the inner ring 62. Under such circumstance, the universal actuator 60 can be 360° moved.

Figure 4:
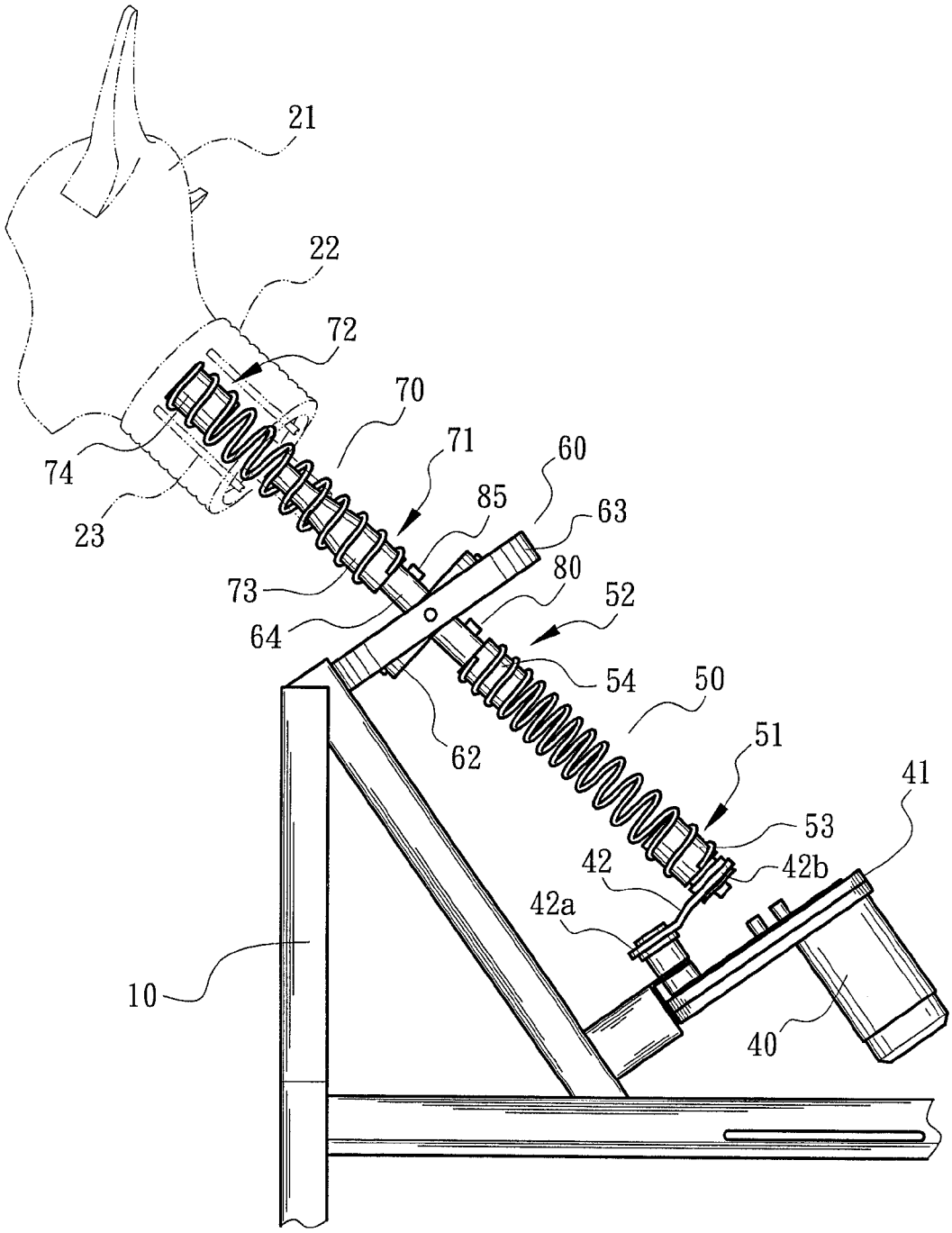
FIG. 4 is a plane view showing the positional relationship between the transmission section, the universal actuator, the driven section and the head model of the present invention.

Please now refer to FIGS. 3 and 4. The connector 61 of the universal actuator 60 is formed with a central through hole 61*a* in which a tubular member 64 is inserted to connect with the connector 61. In a preferred embodiment, the connector 61 and the tubular member 64 are integrally formed. The shaft member 54 of the transmission section 50 is inserted in one end of the tubular member 64 and locked therewith by a bolt 80. The driven section 70 is inserted in the other end of the tubular member 64.

To speak more specifically, the driven section 70 is a flexible or elastic shaft-like structure, which can be elastically bent and rotated within a certain range. In the preferred embodiment, the driven section 70 is substantially in the form of a coil spring, including a first end 71 connected to the tubular member 64 and a second end 72. The first end 71 is provided with a shaft member 73 inserted in the other end of the tubular member 64 and locked therewith by a bolt 85. The second end 72 is provided with a bush 74 for connecting with a bracket 75 (as shown in FIG. 2). The bush 74 is formed with a central passage 74*a* and notches 74*b*.

Figure 5:
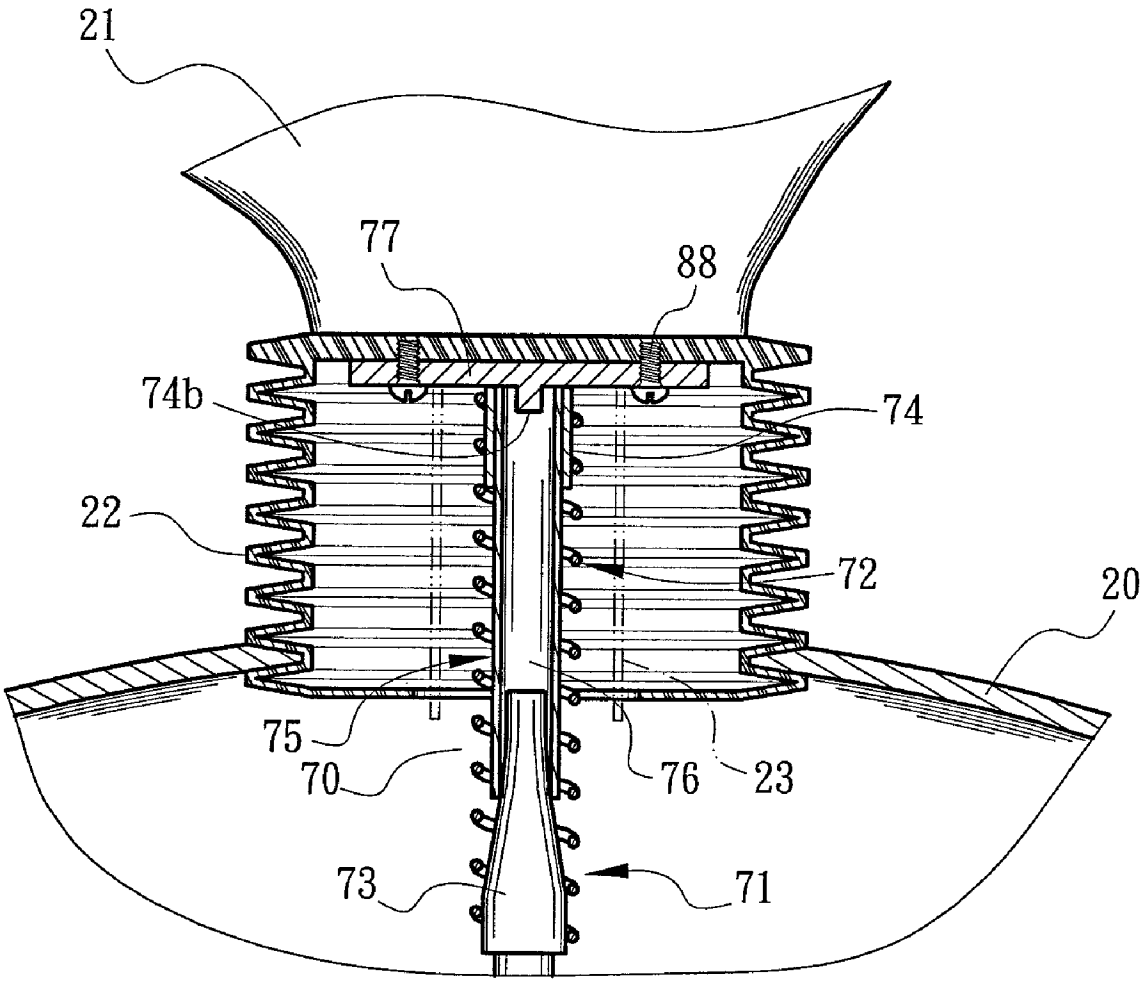
FIG. 5 is a sectional view showing the positional relationship between the head model, the neck section, the bracket and the driven section of the present invention.

Referring to FIG. 5, the bracket 75 has a sleeve 76 with key sections 76*a* and a carrier section 77 normal to the sleeve 76. After the sleeve 76 is fitted into the passage 74*a* of the bush, the key sections 76*a* of the sleeve 76 are inserted in the notches 74*b* of the bush 74. Accordingly, the bracket 75 is assembled with the second end 72 of the driven section 70 and hindered from freely rotating. FIG. 5 also shows that the sleeve 76 of the bracket 75 has such a length that the sleeve 76 extends to a position close to the first end 71 of the driven section 70 to partially enclose the shaft member 73.

Please now refer to FIGS. 2 and 5. A neck section 22 that can be fitted with the animal model 20 is locked on the carrier section 77 of the bracket 75. The neck section 22 is an extensible/compressible and flexible structure, which is movable with the rotation of the driven section 70. FIG. 5 particularly shows that the neck section 22 is locked on the carrier section 77 by means of fixing members or bolts 88. In the preferred embodiment, the head model 21 is provided with projecting posts 23, which can be inserted into perforations 24 formed on the neck section 22. Accordingly, the head model 21 is detachably assembled with the neck section 22 as shown in FIG. 4. In this case, the head model 21 can be conveniently replaced as necessary. Moreover, the head model 21 can be rotated in response to the rotation of the driven section 70.

Figure 6:
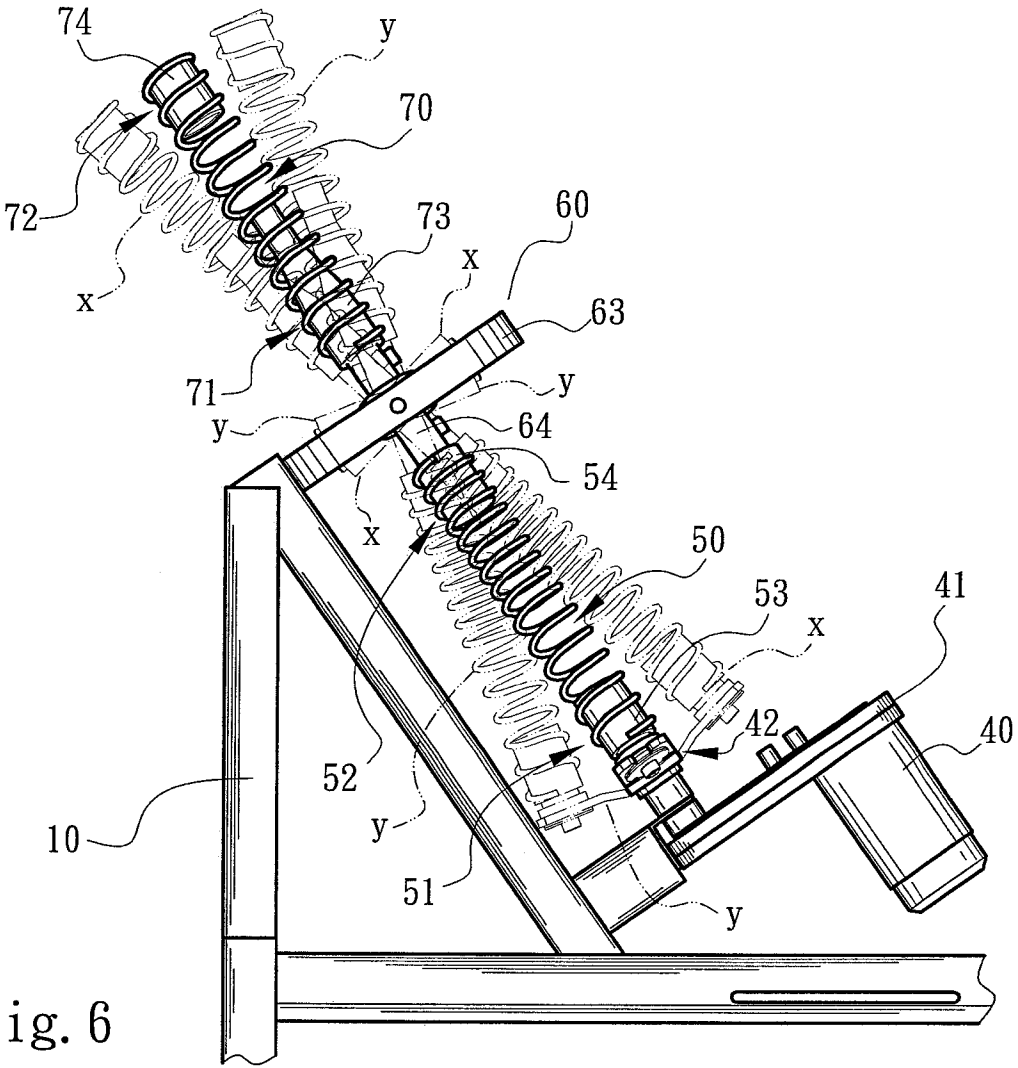
FIG. 6 is a view showing the movements of the steering unit, the transmission section, the universal actuator and the driven section of the present invention.
Figure 8:
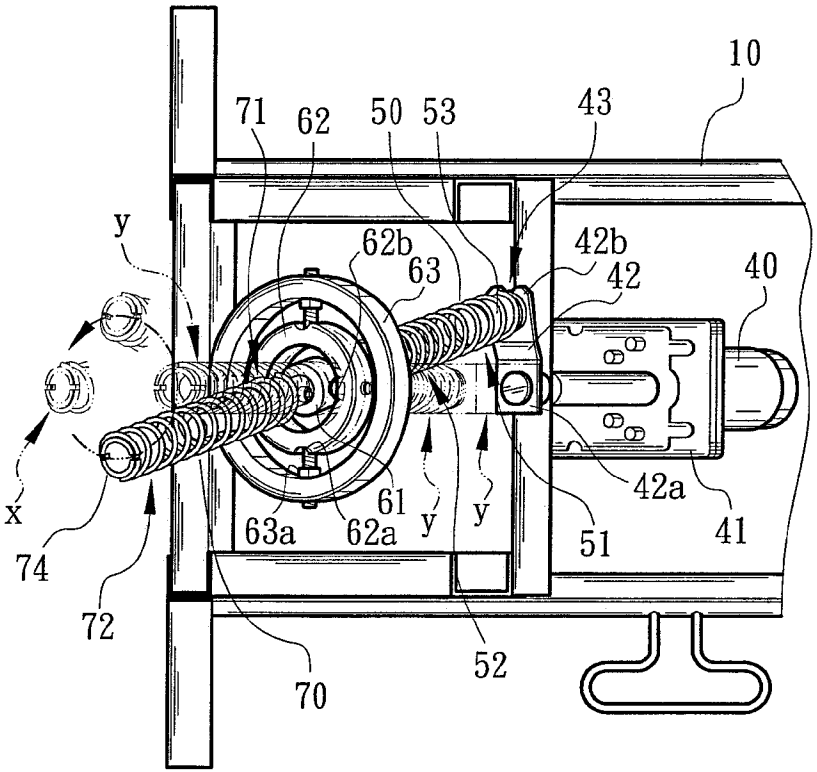
FIG. 8 is a view according to FIG. 7, showing the movements of the steering unit, the transmission section and the driven section of the present invention, also showing the positional relationship therebetween.
Figure 7:
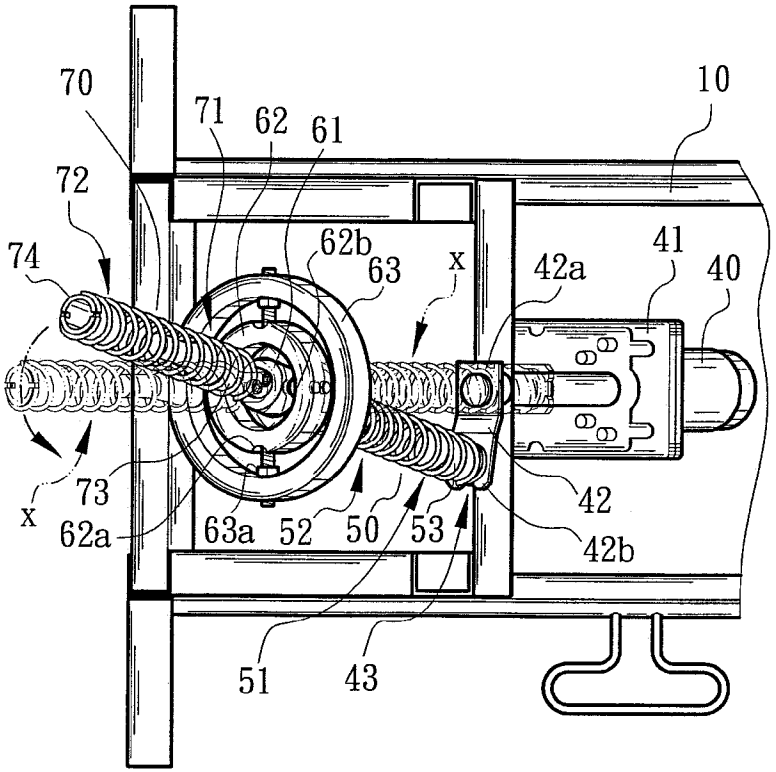
FIG. 7 is a view showing the movements of the steering unit, the transmission section and the driven section of the present invention, also showing the positional relationship therebetween.

Please now refer to FIGS. 6, 7 and 8, which show the movements of the transmission section 50, the universal actuator 60 and the driven section 70. When the steering unit 42 is driven and rotated by the motor 40, the free end 42*b* of the steering unit 42 drives the transmission section 50 to rotate. For example, referring to FIGS. 6 and 7, when the steering unit 42 is rotated from a position shown by solid lines to a right-side position shown by phantom lines x according to FIG. 6, the second end 52 of the transmission section 50 will make the tubular member 64 and the connector 61 drive the inner ring 62 of the universal actuator 60 to up and down (or back and forth) swing. At this time, the driven section 70 drives the head model 21 to rotate to the position shown by phantom lines x of FIGS. 6 and 7.

On the other hand, when the steering unit 42 is moved from the position shown by phantom lines x of FIG. 7 to the position shown by solid lines of FIG. 8, the second end 52 of the transmission section 50 will make the tubular member 64 drive the connector 61 of the universal actuator 60 to left and right swing. At this time, the driven section 70 drives the head model 21 to rotate to the position shown by solid lines of FIG. 8.

As shown by phantom lines y of FIGS. 6 and 8, when the free end 42*b* of the steering unit 42 is moved to a left-side position according to FIG. 6, the second end 52 of the transmission section 50 will make the tubular member 64 and the connector 61 drive the inner ring 62 of the universal actuator 60 to up and down (or back and forth) swing. At this time, the driven section 70 drives the head model 21 to rotate to the position shown by phantom lines y of FIGS. 6 and 8. When the steering unit 42 is further rotated, the free end 42*b* of the steering unit 42 will reach the position shown by solid lines of FIG. 7. At this time, the second end 52 of the transmission section 50 will drive the connector 61 to left and right swing. Simultaneously, the driven section 70 drives the head model 21 to rotate to the position shown by solid lines of FIG. 7.

As aforesaid, the transmission section 50, the universal actuator 60 and the driven section 70 are movable in response to the movement of the steering unit 42 to drive and 360° rotate the head model 21. In contrast, the mechanical head section of the conventional roping practice apparatus can simply swing in one direction.

In a modified embodiment of the present invention, the base body 10 can be equipped with wheels, whereby the base body 10 is movable in cooperation with the transmission mechanism and the power system.

According to the above arrangement, the roping practice apparatus of the present invention has the following advantages:

1. The head model 21 can move in both the left-and-right swinging direction and the up-and-down (or back-and-forth) swinging direction. Therefore, the head model 21 can move within a range of 360° to more realistically simulate the actual movement of the head of a live animal. This overcomes the defects of the conventional roping practice apparatus.
2. The universal actuator 60 includes the outer ring 63, the inner ring 62 and the connector 61. The universal actuator 60 is driven by the steering unit 42 through the transmission section 50 to make the driven section 70 universally drive and rotate the head model 21. Such design is apparently different from the conventional roping practice apparatus that simply adopts a linkage mechanism to drive and swing the head model in a specific direction. In comparison with the conventional roping practice apparatus, the head model 21 of the present invention can be moved within a range of 360° without limitation to any specific direction.
3. The driving mechanism for driving the head model 21 is simplified and easy to assemble/disassemble. In contrast, the conventional roping practice apparatus has complicated structure and is hard to assemble/disassemble. Also, the conventional roping practice apparatus is manufactured at higher cost.

The above embodiments are only used to illustrate the present invention, not intended to limit the scope thereof. Many modifications of the above embodiments can be made without departing from the spirit of the present invention.

What is claimed is:

1. A roping practice apparatus comprising:

a steering unit drivable and rotatable by a power source;

a transmission section rotatable in response to the rotation of the steering unit, the transmission section having a first end mounted on the steering unit and a second end;

a universal actuator to which the second end of the transmission section is pivotally connected; and a driven section having a first end mounted on the universal actuator and a second end adapted to be roped, the driven section being fully rotatable in response to the rotation of the transmission section.

2. The roping practice apparatus as claimed in claim 1, wherein the steering unit, the transmission section, the universal actuator and the driven section are mounted on a base body.

3. The roping practice apparatus as claimed in claim 2, wherein the base body is provided with a power system, a controller, a motor drivable by the power system and a transmission mechanism or gear case assembled with the motor for driving the steering unit mounted on the transmission mechanism or the gear case.

4. The roping practice apparatus as claimed in claim 2, wherein an animal model is mounted and supported on the base body and a head model is mounted on the second end of the driven section.

5. The roping practice apparatus as claimed in claim 1, wherein the steering unit is in the form of a cantilever structure having a fixed end drivable by the power source and a free end pivotally connected with the transmission section.

6. The roping practice apparatus as claimed in claim 3, wherein the steering unit is in the form of a cantilever structure having a fixed end and a free end, the fixed end being connected with the transmission mechanism or the gear case, the free end having an opening to which the first end of the transmission section is pivotally connected.

7. The roping practice apparatus as claimed in claim 1, wherein the steering unit is in the form of a disc-shaped structure and eccentrically pivotally connected with the first end of the transmission section.

8. The roping practice apparatus as claimed in claim 4, wherein the steering unit is in the form of a disc-shaped structure and eccentrically pivotally connected with the first end of the transmission section.

9. The roping practice apparatus as claimed in claim 1, wherein the transmission section is an elastic shaft-like structure.

10. The roping practice apparatus as claimed in claim 4, wherein the transmission section is an elastic shaft-like structure.

11. The roping practice apparatus as claimed in claim 1, wherein the first end of the transmission section is provided with an accessory locked to an opening formed on the steering unit.

12. The roping practice apparatus as claimed in claim 1, wherein the second end of the transmission section is provided with a shaft member pivotally connected with the universal actuator.

13. The roping practice apparatus as claimed in claim 1, wherein the transmission section is a flexible shaft-like structure.

14. The roping practice apparatus as claimed in claim 4, wherein the transmission section is a flexible shaft-like structure.

15. The roping practice apparatus as claimed in claim 1, wherein the transmission section is substantially in the form of a coil spring.

16. The roping practice apparatus as claimed in claim 1, wherein the universal actuator is a ring-like structure, including:

an outer ring, two pins (63*a*) being disposed on the outer ring in positions opposite to each other and radially directed to a center of the outer ring;

an inner ring formed with two shaft sockets in positions opposite to each other corresponding to the pins (63*a*), the pins (63*a*) of the outer ring being pivotally connected to the shaft sockets, whereby the inner ring is swingably shaft-supported in the outer ring, two pins (62*b*) being disposed on the inner ring in positions opposite to each other and radially directed to a center of the inner ring; and a connector shaft-supported in the inner ring by the pins (62*b*), whereby the connector can be swung about the pins (62*b*).

17. The roping practice apparatus as claimed in claim 4, wherein the universal actuator is a ring-like structure, including:

an outer ring, two pins (63*a*) being disposed on the outer ring in positions opposite to each other and radially directed to a center of the outer ring;

an inner ring formed with two shaft sockets in positions opposite to each other corresponding to the pins (63*a*), the pins (63*a*) of the outer ring being pivotally connected to the shaft sockets, whereby the inner ring is swingably shaft-supported in the outer ring, two pins (62*b*) being disposed on the inner ring in positions opposite to each other and radially directed to a center of the inner ring; and a connector shaft-supported in the inner ring by the pins (62*b*), whereby the connector can be swung about the pins (62*b*).

18. The roping practice apparatus as claimed in claim 16, wherein the positions of the pins (62*b*) disposed on the inner ring are about 90° angularly spaced from the shaft sockets (62*a*) respectively.

19. The roping practice apparatus as claimed in claim 16, wherein the connector swings in a direction other than a swinging direction of the inner ring, whereby the universal actuator can move within a range of 360°.

20. The roping practice apparatus as claimed in claim 16, wherein the connector is formed with a central through hole in which a tubular member is disposed.

21. The roping practice apparatus as claimed in claim 20, wherein the connector and the tubular member are integrally formed.

22. The roping practice apparatus as claimed in claim 20, wherein the second end of the transmission section is inserted in one end of the tubular member and the first end of the driven section is inserted in the other end of the tubular member.

23. The roping practice apparatus as claimed in claim 17, wherein the outer ring is fixed on the base body.

24. The roping practice apparatus as claimed in claim 1, wherein the universal actuator is in the form of a universal joint structure.

25. The roping practice apparatus as claimed in claim 1, wherein the driven section is an elastic shaft-like structure.

26. The roping practice apparatus as claimed in claim 4, wherein the driven section is an elastic shaft-like structure.

27. The roping practice apparatus as claimed in claim 1, wherein the driven section is a flexible shaft-like structure.

28. The roping practice apparatus as claimed in claim 4, wherein the driven section is a flexible shaft-like structure.

29. The roping practice apparatus as claimed in claim 1, wherein the first end of the driven section is provided with a shaft member connected with a connector of the universal actuator.

30. The roping practice apparatus as claimed in claim 1, wherein a head model is assembled with the second end of the driven section.

31. The roping practice apparatus as claimed in claim 30, wherein the second end of the driven section is provided with a bush for connecting with a bracket.

32. The roping practice apparatus as claimed in claim 31, wherein the bush is formed with a central passage and notches.

33. The roping practice apparatus as claimed in claim 31, wherein the bracket has a sleeve with key sections and a carrier section normal to the sleeve.

34. The roping practice apparatus as claimed in claim 33, wherein the sleeve is assembled with the second end of the driven section.

35. The roping practice apparatus as claimed in claim 33, wherein the sleeve of the bracket has such a length that the sleeve extends to a position close to the first end of the driven section.

36. The roping practice apparatus as claimed in claim 33, wherein a neck section is locked on the carrier section of the bracket and fitted with the head model.

37. The roping practice apparatus as claimed in claim 36, wherein the neck section is an extensible/compressible and flexible structure.

38. The roping practice apparatus as claimed in claim 36, wherein the neck section is formed with at least one perforation.

39. The roping practice apparatus as claimed in claim 36, wherein the head model is assembled with the neck section.

40. The roping practice apparatus as claimed in claim 39, wherein the head model is provided with at least one projecting post, which can be inserted into the perforation of the neck section, whereby the head model is detachably assembled with the neck section.

41. The roping practice apparatus as claimed in claim 1, wherein the second end of the transmission section is provided with a shaft member connected with a connector of the universal actuator.

42. The roping practice apparatus as claimed in claim 16, wherein the connector is provided with a tubular member, the second end of the transmission section being provided with a shaft member, the shaft member of the transmission section being inserted in and assembled with one end of the tubular member, the first end of the driven section being provided with a shaft member, the shaft member of the driven section being inserted in and assembled with the other end of the tubular member.

43. The roping practice apparatus as claimed in claim 42 wherein the shaft members are inserted in the tubular member and locked therewith by bolts.

* * * * *